US007446764B2

(12) United States Patent
Ishizu et al.

(10) Patent No.: US 7,446,764 B2
(45) Date of Patent: Nov. 4, 2008

(54) DISPLAY CONTROL DEVICE, DISPLAY CONTROL METHOD, AND THE LIKE

(75) Inventors: Kazunori Ishizu, Kawagoe (JP); Yuji Takatori, Kawagoe (JP); Yoichi Hara, Kawagoe (JP); Yasuhide Homma, Kawagoe (JP)

(73) Assignee: Pioneer Corporation, Meguro-ku, Tokyo (JP)

( * ) Notice: Subject to any disclaimer, the term of this patent is extended or adjusted under 35 U.S.C. 154(b) by 131 days.

(21) Appl. No.: 10/594,894

(22) PCT Filed: Mar. 23, 2005

(86) PCT No.: PCT/JP2005/005279

§ 371 (c)(1),
(2), (4) Date: Sep. 29, 2006

(87) PCT Pub. No.: WO2005/098810

PCT Pub. Date: Oct. 20, 2005

(65) Prior Publication Data

US 2007/0132745 A1 Jun. 14, 2007

(30) Foreign Application Priority Data

Mar. 31, 2004 (JP) ..... 2004-102251

(51) Int. Cl.
*G09G 5/00* (2006.01)

(52) U.S. Cl. ..... 345/213; 345/204

(58) Field of Classification Search ..... 345/83–84, 345/92, 98–100, 204, 208, 210–214
See application file for complete search history.

(56) References Cited

U.S. PATENT DOCUMENTS 6,359,600 B1 * 3/2002 Mijnsbergen et al. ..... 345/3.3

(Continued)

FOREIGN PATENT DOCUMENTS

EP 1 542 202 6/2005

(Continued)

*Primary Examiner*—Richard Hjerpe
*Assistant Examiner*—Mansour M Said
(74) *Attorney, Agent, or Firm*—Drinker Biddle & Reath LLP

(57) ABSTRACT

The display control device that causes a display screen to display predetermined image information includes; a display adjustment signal superimposing unit that superimposes a display adjustment signal for adjusting the timing of displaying a pixel in accordance with image information, on a portion of a signal corresponding to a region outside the display screen on a horizontal scanning line; an image signal sampling unit that performs sampling for an image signal in accordance with the image information in predetermined sampling timing; a display control unit that performs display control for the pixel, using a value obtained through the sampling performed by the image signal sampling unit; a display adjustment signal sampling unit that performs sampling for the display adjustment signal in predetermined sampling timing; an optimum display timing detecting unit that detects optimum timing of displaying the pixel by changing the sampling timing in the display adjustment signal sampling unit, based on a value obtained through the sampling performed by the display adjustment signal sampling unit, until the optimum timing of displaying the pixel is determined; and a timing adjusting unit that adjusts the sampling timing in the image signal sampling unit to the optimum display timing, when the optimum display timing detecting unit detects the optimum display timing.

14 Claims, 6 Drawing Sheets

U.S. PATENT DOCUMENTS

2005/0162417 A1* 7/2005 Taguchi et al. ..... 345/418

FOREIGN PATENT DOCUMENTS

JP 9-044122 2/1997
JP 2000-003151 1/2000
JP 2000-122621 4/2000
JP 2001-331141 11/2001

* cited by examiner

DISPLAY CONTROL DEVICE, DISPLAY CONTROL METHOD, AND THE LIKE

FIELD OF THE INVENTION

The present invention relates to the technical field of display control devices, display control methods, and the like for displaying predetermined image information on display screens.

BACKGROUND OF THE INVENTION

As higher-resolution images (video images) are to be displayed on display units such as monitors and display devices these days, the number of display pixels of a display unit is made equal to the number of pixels in an image signal having the image information in an attempt to bring out the highest display capacity of the display unit. In a navigation system, for example, an image signal having map image information is output from the drawing unit in compliance with the number of display pixels of the display unit, so that the number of pixels in the image signal becomes equal to the number of display pixels in the display unit. By doing so, a clear image (picture) is presented.

However, if the image signal from the drawing unit is output in different timing from the timing of displaying each pixel on the display unit, a blurred image is displayed. Therefore, the timing of displaying pixels is manually changed and adjusted, while the operator is monitoring the image actually displayed on the display unit.

Patent Document 1 discloses a display device that can synchronize the timing of displaying each pixel on the display unit with a display clock signal that controls the pixel display timing, and accordingly can prevent feathering and blurring in each image. More specifically, in each video signal that is output from the image generating unit of the display device, a horizontal position fine-adjustment signal for controlling the timing of displaying each pixel contained in the image to be displayed is superimposed on a predetermined horizontal scanning line within a vertical return period corresponding to an outside region that is located outside the display screen of the display unit and does not contribute to the display of the image. The region in the vicinity of the peak value of the horizontal position fine-adjustment signal (a non-square wave) is compared with a reference voltage (the threshold), and corrugating is then performed to output a "high" signal. Based on the timing of the "high" signal, the timing of the display clock signal is adjusted.

Patent Document 1: Japanese Patent Application Laid-Open No. 2000-122621

DISCLOSURE OF THE INVENTION

Problems to be Solved by the Invention

In such a conventional display device, however, the operating unit that performs timing adjustment during the period, in which timing adjustment is performed between the drawing dots in the drawing unit and the display pixels (display dots) in the display unit or the timing of the display clock signal is adjusted (normally more than once), affects the display of the image information on the display unit. In some cases, a displayed image (a video image) might repeatedly switch between a clear state and a blurred state, for example. To avoid such an undesirable display state, overwrite display such as OSD (On Screen Display) to announce the adjusting operation is performed, or the backlight of the liquid crystal panel is turned off. In either case, however, desirable display for users is interrupted.

Therefore, a general object of the present invention is to eliminate the above problems, and a more specific object of the present invention is to provide a display control device that can maintain excellent display for users while the pixel display timing is being adjusted. The present invention also provides a display control method and the like.

Means to Solve the Problems

To solve the above problems, an aspect of the present invention provides a display control device that causes a display screen to display predetermined image information. This display control device includes: a display adjustment signal superimposing unit that superimposes a display adjustment signal for adjusting the timing of displaying a pixel in accordance with image information, on a portion of a signal corresponding to a region outside the display screen on a horizontal scanning line; an image signal sampling unit that performs sampling for an image signal in accordance with the image information in predetermined sampling timing; a display control unit that performs display control for the pixel, using a value obtained through the sampling performed by the image signal sampling unit; a display adjustment signal sampling unit that performs sampling for the display adjustment signal in predetermined sampling timing; an optimum display timing detecting unit that detects optimum timing of displaying the pixel by changing the sampling timing in the display adjustment signal sampling unit, based on a value obtained through the sampling performed by the display adjustment signal sampling unit, until the optimum timing of displaying the pixel is determined; and a timing adjusting unit that adjusts the sampling timing in the image signal sampling unit to the optimum display timing, when the optimum display timing detecting unit detects the optimum display timing.

In this display control device, the timing adjusting unit changes the sampling timing in the image signal sampling unit, so as to adjust the sampling timing in the image signal sampling unit to the optimum display timing.

In this display control device, the timing adjusting unit changes the sampling timing in the image signal sampling unit by a predetermined amount at a time.

This display control device further includes a drawing unit that creates the image information and outputs the image signal. In this display control device, the timing adjusting unit changes the timing of outputting the image signal in the drawing unit, so as to adjust the sampling timing in the image signal sampling unit to the optimum display timing.

In this display control device, the timing adjusting unit changes the timing of outputting the image signal in the drawing unit by a predetermined amount at a time.

In this display control device, the timing adjusting unit adjusts the sampling timing in the image signal sampling unit to the optimum display timing when a change cannot be recognized by a user or is difficult for a user to recognize from image information displayed on the display screen.

In this display control device, the timing adjusting unit adjusts the sampling timing in the image signal sampling unit to the optimum display timing when scene switching is performed.

In this display control device, the timing adjusting unit adjusts the sampling timing in the image signal sampling unit to the optimum display timing when the luminance level of the display screen is lower than a predetermined threshold value.

In this display control device, the display adjustment signal is superimposed on a portion of a signal corresponding to a region outside the display screen on a horizontal scanning line and also corresponding to a region that can display the image information.

In this display control device, a signal on which the display adjustment signal is to be superimposed is at least one of an image signal representing a color component contained in the image information, a luminance signal, and a synchronization signal.

In this display control device, the display adjustment signal is a signal in synchronization with drawing dots.

In this display control device, the display adjustment signal is a signal representing one display pixel.

To solve the above problems, another aspect of the present invention provides a display control method for causing a display screen to display predetermined image information. This method includes the steps of: superimposing a display adjustment signal for adjusting the timing of displaying a pixel in accordance with image information, on a portion of a signal corresponding to a region outside the display screen on a horizontal scanning line; performing sampling for an image signal in accordance with the image information in predetermined sampling timing; performing display control for the pixel, using a value obtained through the sampling for the image signal; performing sampling for the display adjustment signal in predetermined sampling timing; detecting optimum timing of displaying the pixel by changing the sampling timing for the display adjustment signal, based on a value obtained through the sampling for the display adjustment signal, until the optimum timing of displaying the pixel is determined; and adjusting the sampling timing for the image signal to the optimum display timing, when the optimum display timing is detected.

To solve the above problems, yet another aspect of the present invention provides a display control program that causes a computer to display predetermined image information on a display screen, and causes the computer to function as: a display adjustment signal superimposing unit that superimposes a display adjustment signal for adjusting the timing of displaying a pixel in accordance with image information, on a portion of a signal corresponding to a region outside the display screen on a horizontal scanning line; an image signal sampling unit that performs sampling for an image signal in accordance with the image information in predetermined sampling timing; a display control unit that performs display control for the pixel, using a value obtained through the sampling performed by the image signal sampling unit; a display adjustment signal sampling unit that performs sampling for the display adjustment signal in predetermined sampling timing; an optimum display timing detecting unit that detects optimum timing of displaying the pixel by changing the sampling timing in the display adjustment signal sampling unit, based on a value obtained through the sampling performed by the display adjustment signal sampling unit, until the optimum timing of displaying the pixel is determined; and a timing adjusting unit that adjusts the sampling timing in the image signal sampling unit to the optimum display timing, when the optimum display timing detecting unit detects the optimum display timing.

To solve the above problems, still another aspect of the present invention provides a recording medium on which the above display control program is recorded in a computer-readable fashion.

EXPLANATION OF REFERENCE NUMERALS

Figure 1:
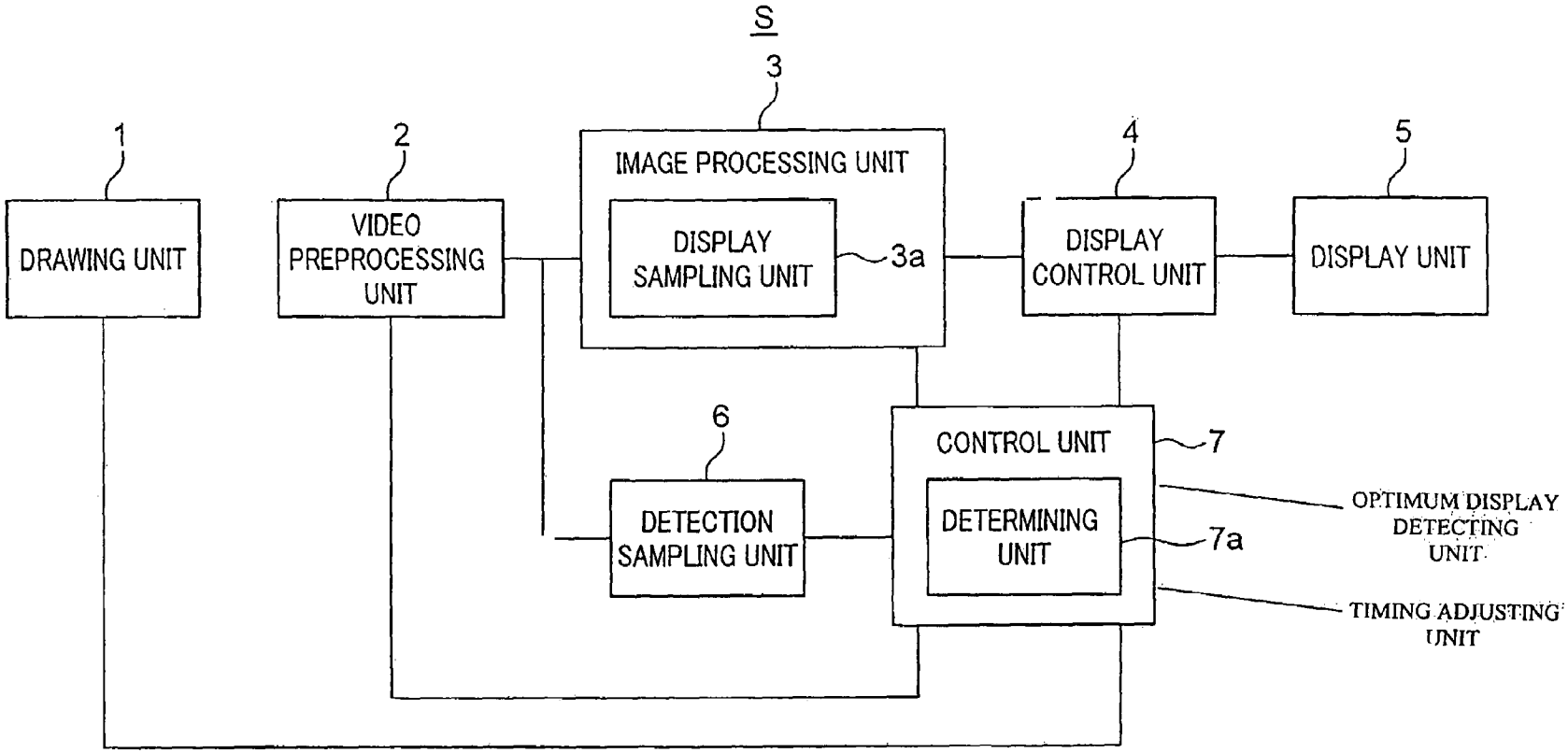
FIG. 1 is a block diagram schematically showing a display control device provided in a car navigation system in accordance with an embodiment of the present invention.

1 drawing unit
2 video preprocessing unit
3*a* display sampling unit
3*b* sampling unit image processing unit
4 display control unit
5 display unit
6 detection sampling unit
7 control unit
7*a* determining unit
S display control device

PREFERRED EMBODIMENTS FOR CARRYING OUT THE INVENTION

The following is a description of a preferred embodiment of the present invention, with reference to the accompanying drawings. In the embodiment described below, the present invention is applied to a car navigation system.

Referring first to FIG. 1, the structure and functions of a display control device in a car navigation system in accordance with this embodiment are described.

FIG. 1 is a block diagram schematically showing the display control device in the car navigation system in accordance with this embodiment.

As shown in FIG. 1, the display control device S includes a drawing unit 1 as an example of the claimed drawing unit and display adjustment signal superimposing unit, a video preprocessing unit 2 as an example of the claimed drawing unit, an image (video) processing unit 3 having a display sampling unit 3*a* as an example of the claimed image signal sampling unit, a display control unit 4 as an example of the claimed display control unit, a display unit 5 having a display screen such as liquid crystal panel, a detection sampling unit 6 as an example of the claimed display adjustment signal sampling unit, and a control unit 7 as an example of the claimed optimum display timing detecting unit and timing adjusting unit.

The car navigation system includes a GPS receiving unit that receives radio waves transmitted from a GPS satellite network and detects the current position information (including the latitude and the longitude), a sensor unit having a velocity sensor, an acceleration sensor, a gyro sensor, and the like, an operation unit that receives operation instructions from operators or the likes, a memory unit that stores various kinds of information such as map information, a control unit that performs known navigation (such as path searches and map matching) based on the information detected by the GPS receiving unit and the sensor unit, and also based on instruction information that is received by the operation unit from operators and the like. However, those components are not shown in the drawings.

The drawing unit 1 generates signals for displaying image (video) information (image information to be displayed on the display screen of the display unit 5) including map information designated by the control unit of the car navigation system. For example, the drawing unit 1 generates image (video) signals representing the color components of RGB. In doing so, the drawing unit 1 superimposes a display adjustment signal (such as a square-wave signal) for adjusting the timing of displaying the pixels of the image information, on the portion of each signal corresponding to the region outside the display screen of the display unit 5 on the horizontal scanning line for an image signal of the R component and also corresponding to the region that can display the image information.

The relationship between the image signals and the region outside the display screen of the display unit 5 is now described.

Figure 2:
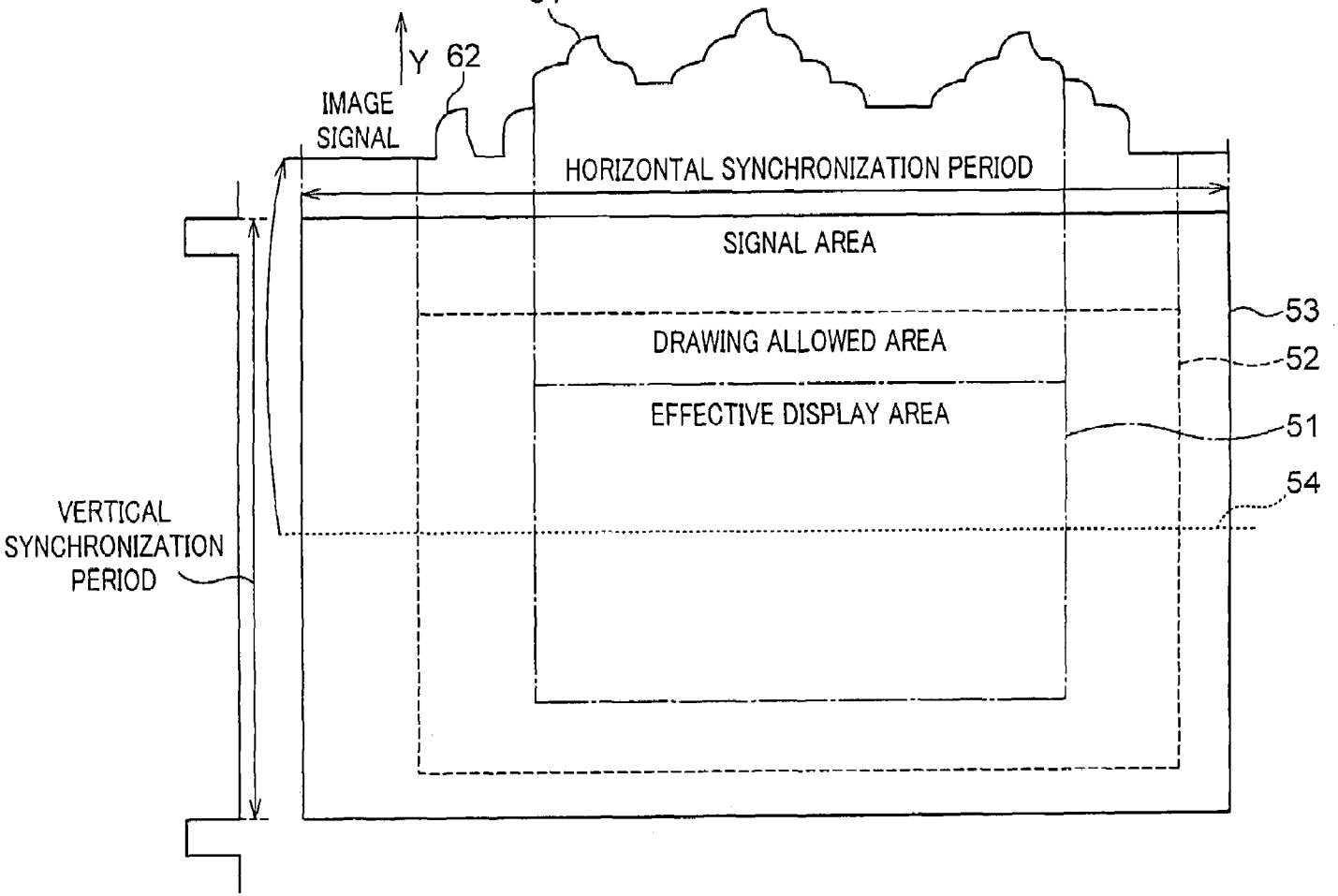
FIG. 2 is a conceptual diagram sowing an example of the relationship between an image signal (an image signal of the R component, for example) and the region outside the display screen of the display unit 5.

FIG. 2 is a conceptual diagram of an example of the relationship between an image signal (an image signal of the R component) and the region outside the display screen of the display unit 5. FIG. 2 shows a signal area 53, a drawing allowed area 52, and a valid display area 51. The signal area 53 includes the drawing allowed area 52 and the valid display area 51. The drawing allowed area 52 includes the valid display area 51.

The valid display area 51 is equivalent to the region of the display screen of the display unit 5, and is the region that actually displays image information.

The drawing allowed area 52 is a region in which image information can be displayed. Since the region of the actual display screen is located in the valid display area 51, image information is not to be displayed in the region that is located outside the valid display area 51 but in the drawing allowed area 52. However, displaying image information in the drawing allowed area 52 is made possible by increasing the area of the display screen of the display unit 5. The region that is located outside the valid display area 51 but in the drawing allowed area 52 is equivalent to the region outside the display screen, and is also equivalent to the region that can display image information.

The region that is located outside the drawing allowed area 52 but in the signal area 53 is the region that does not contribute to image display (the region that cannot display image information).

Meanwhile, the image signal shown above and outside the signal area 53 in FIG. 2 is an example of a signal on a horizontal scanning line 54 that substantially crosses the centers of the signal area 53, the drawing allowed area 52, and the valid display area 51. The vertical direction (the Y-direction) indicates the luminance of each pixel. In this image signal, the signal 61 of each pixel exists in the signal portion corresponding to the valid display area 51.

In this image signal, a display adjustment signal 62 as well as the signal 61 of each pixel exists in the signal portion corresponding to the drawing allowed area 52. Here, the display adjustment signal 62 is superimposed on the signal portion corresponding to the region located outside the valid display area 51 but located in the drawing allowed area 52. Since the region in the drawing allowed area 52 corresponds to the signal portion from which the image signal is generated, the drawing unit 1 can perform the superimposing of the display adjustment signal 62.

In this image signal, neither the signal 61 of each pixel nor the display adjustment signal 62 exist in the signal portion corresponding to the region located outside the drawing allowed area 52 but located in the signal area 53, and this signal portion includes the horizontal and vertical retrace periods.

As shown in FIG. 2, the signal 61 of each pixel and the display adjustment signal 62 each have a gentle rising edge, which is so-called "rounding". This is caused due to the great lengths of the transmission lines (in a car navigation system, for example, the cable between the drawing unit 1 and the video preprocessing unit 2 and the cable between the video preprocessing unit and the image processing unit 3 might be as long as 1 to 6 meters) and the frequency characteristics of the transmission lines. Since the signal 61 of each pixel and the display adjustment signal 62 are equally affected by the lengths of the transmission lines and the frequency characteristics of the transmission lines, the same rounding is caused in both signals. Furthermore, in a case where the signal 61 of each pixel and the display adjustment signal 62 have the same durations, the timing of having the highest amplitude from the rising is considered to be substantially the same for both signals. Therefore, the signal 61 of each pixel is considered to become the highest when the display adjustment signal 62 becomes the highest.

The image signal generated in the above manner is output, together with a synchronization signal, to the video preprocessing unit 2.

The video preprocessing unit 2 performs switching, filtering, attenuating, and amplifying for the image signal, so that the image signal can cope with the I/Fs in the later stages such as the image processing unit 3 and the detection sampling unit 6. The image signal and the synchronization signal are then output to the image processing unit 3 and the detection sampling unit 6.

The image processing unit 3 performs for the image (video) signal from the video preprocessing unit 2, an image format changing process in compliance with the display control unit 4 and the display unit 5, a luminance and contrast adjusting process for the image (video) signal representing to each color component, a scaling process for changing screen modes, a gamma process, and the like. The image processing unit 3 also divides the synchronization signal supplied from the video preprocessing unit 2 into a horizontal synchronization signal and a vertical synchronization signal, and outputs them to the display control unit 4. The horizontal synchronization signal is supplied at the starting points of all the horizontal scanning lines, including the horizontal scanning line 54, in the region that is located outside the drawing allowed area 52 but in the signal area 53. The vertical synchronization signal is supplied at the upper end points in the region that is located outside the drawing allowed area 52 but in the signal area 53.

The display sampling unit 3*a* of the image processing unit 3 performs sampling on the signal of each pixel in the image signal in predetermined sampling timing (for example, a clock signal of a predetermined cycle is generated, and sampling is performed in synchronization with the clock signal). The pixel signal equivalent to the sampling value is output to the display control unit 4. The display sampling unit 3*a* serves as an A/D converter if the input image signal is an analog signal, and serves as a H/L detector if the input image signal is a digital signal.

The display control unit 4 includes a horizontal driver and a vertical driver. The horizontal driver and the vertical driver control the pixels of each line on a liquid crystal panel, for example, of the display unit 5, based on the input pixel signal, the horizontal synchronization signal, the vertical synchronization signal, and the like. In this manner, display of each pixel in accordance with the image information is controlled (the display of pixels is controlled based on the value used in the sampling performed by the display sampling unit 3*a*).

The detection sampling unit 6 performs sampling on the display adjustment signal 62 superimposed on the image signal in predetermined sampling timing (for example, a clock signal of a predetermined cycle is generated, and sampling is performed in synchronization with the clock signal), and the sampling value is output to the control unit 7. The detection sampling unit 6 is independent of the display sampling unit 3*a,* and operates while not affecting the sampling operation of the display sampling unit 3*a* (the detection sampling unit 6 and the display sampling unit 3*a* operate independently of each other).

Figure 3:
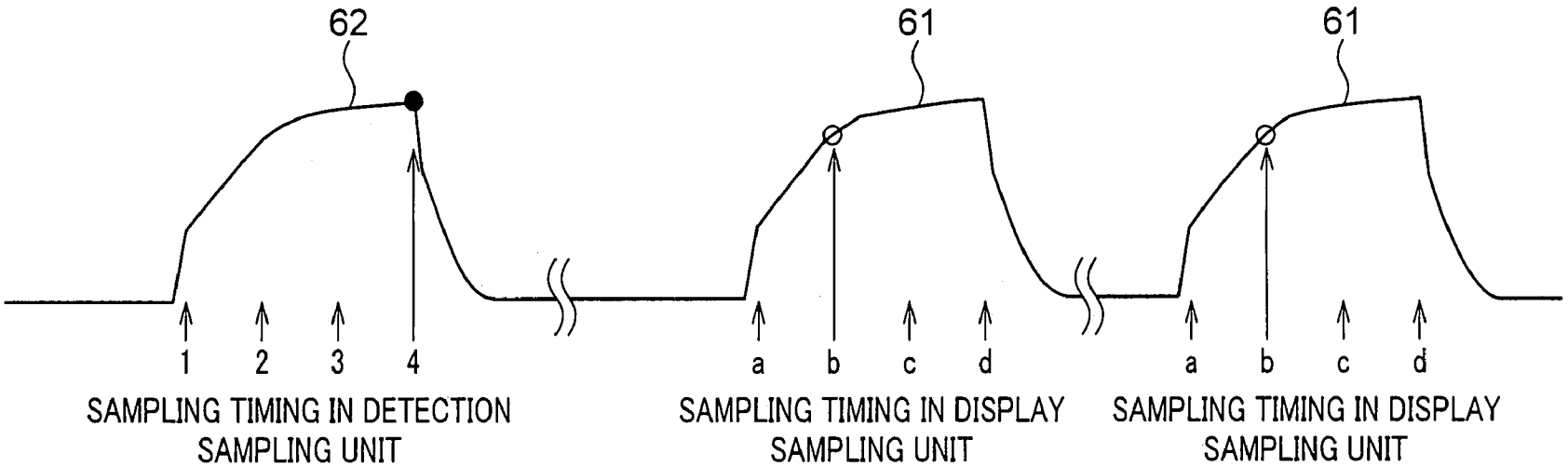
FIG. 3 showing examples of the sampling timing for the image signal and the sampling timing for the display adjustment signal.

FIG. 3 shows examples of sampling timings for the image signal and the display adjustment signal. The sampling for the pixel signal 61 in the image signal is performed by the display sampling unit 3*a,* while the sampling for the display adjustment signal 62 in the image signal is performed by the detection sampling unit 6. As shown in FIG. 3, the sampling for the pixel signal 61 and the sampling for the display adjustment signal 62 are independent of each other. Sampling timings 1, 2, 3, and 4 for the display adjustment signal 62 correspond to sampling timings a, b, c, and d for the pixel signal 61, respectively. For example, the sampling timing 1 and the sampling timing a are the same in each pixel. In the example shown in FIG. 3, the sampling timing for the pixel signal 61 and the sampling timing for the display adjustment signal 62 are different from each other in each pixel (while the sampling timing for the display adjustment signal 62 is "4", the sampling timing for the pixel signal 61 is "b").

The control unit 7 is formed mainly with a CPU, for example, to control the operations of the drawing unit 1, the video preprocessing unit 2, the image processing unit 3, the display control unit 4, and the detection sampling unit 6. The control unit 7 also includes the determining unit 7*a,* which detects the optimum display timing based on the sampling value from the detection sampling unit 6. The optimum display timing is a display timing in the vicinity of the highest luminance in the pixels, and may be a timing in the vicinity of the peak value (the largest amplitude from the rising of the signal) of the display adjustment signal 62, for example. Alternatively, a stable display timing in the vicinity of the highest luminance in the pixels may be set as the optimum display timing.

As an example of the detection of the optimum display timing, the determining unit 7*a* operates as follows. First, the determining unit 7*a* sets a predetermined threshold value (a threshold level). If the sampling value from the detection sampling unit 6 is larger than the threshold value, the sampling timing is detected as the optimum display timing. If the sampling value from the detection sampling unit 6 is smaller than the threshold value, the control unit 7 controls the detection sampling unit 6 to change (shift) the sampling timing in the detection sampling unit 6, so that the sampling timing becomes the optimum display timing. Thus, the optimum display timing is detected.

In another example of the operation of detecting the optimum display timing, the control unit 7 controls the detection sampling unit 6 to perform sampling several times in sampling timings each shifted by a predetermined period. The determining unit 7*a* may be designed to detect the optimum display timing to be the timing in which the maximum sampling value among the sampling values from the detection sampling unit 6 is obtained. In a case where the display adjustment signal 62 having the smallest value is to be input to the detection sampling unit 6 (for example, in a case where the display adjustment signal 62 is to be inverted by an inverter or the like, or a case where a signal obtained by inverting the display adjustment signal 62 is superimposed), the timing in which the smallest sampling value among several sampling values is obtained is detected as the optimum timing.

In this manner, the control unit 7 changes the sampling timing in the detection sampling unit 6 until the optimum display timing is obtained, and eventually detects (determines) the optimum display timing. Until the optimum display timing is detected, the sampling timing in the detection sampling unit 6 is changed, but the sampling timing in the display sampling unit 3*a* is not changed at all.

If the optimum display timing is detected, the control unit 7, as an example of the claimed timing adjusting unit, controls the display sampling unit 3*a* of the image processing unit 3 to change the sampling timing to the optimum sampling timing (by issuing a change instruction, for example). The display sampling unit 3*a* then operates as an example of the claimed timing adjusting unit, and changes the sampling timing in the display sampling unit 3*a* to the optimum display timing. In this manner, the display sampling unit 3*a* performs sampling for the signal of each pixel in the image signal in the optimum display timing.

In the example shown in FIG. 3, when the sampling timing "4" for the display adjustment signal 62 is the optimum timing, the sampling timing for the pixel signal 61 is changed from "b" to "d".

The timing adjusting unit that adjusts the sampling timing in the display sampling unit 3*a* to the optimum display timing if the optimum display timing is detected is not limited to the control unit 7 and the display sampling unit 3*a*. For example, if the optimum display timing is detected, the control unit 7, as an example of the claimed timing adjusting unit, controls the drawing unit 1 or the video preprocessing unit 2 to change the timing of outputting the image signal (by issuing a change instruction, for example), and the drawing unit 1 or the video preprocessing unit 2 operates as an example of the claimed timing adjusting unit and changes the timing of outputting the image signal, so as to adjust the sampling timing in the display sampling unit 3*a* to the optimum display timing.

Here, the change to the optimum display timing in the display sampling unit 3*a* is carried out (by changing the sampling timing in the display sampling unit 3*a* or changing the timing of outputting the image signal from the drawing unit 1 or the video preprocessing unit 2), when the change cannot be recognized by a user or is difficult for a user to recognize from the image information displayed on the display screen, or when disturbance in the image (the image is repeatedly blurred and recovers to a clear state, for example) due to the change to the optimum display timing is not so large that a user does not notice. For example, the sampling timing may be changed by a predetermined amount until it becomes the optimum display timing, or may be changed to the optimum display timing at the time of scene switching, or may be changed to the optimum timing when the luminance level of the display screen is lower than a predetermined threshold value (when the display screen is black, for example). The luminance level of the display screen may be the luminance level of the entire screen or maybe the luminance level of a given area of the screen.

Figure 4:
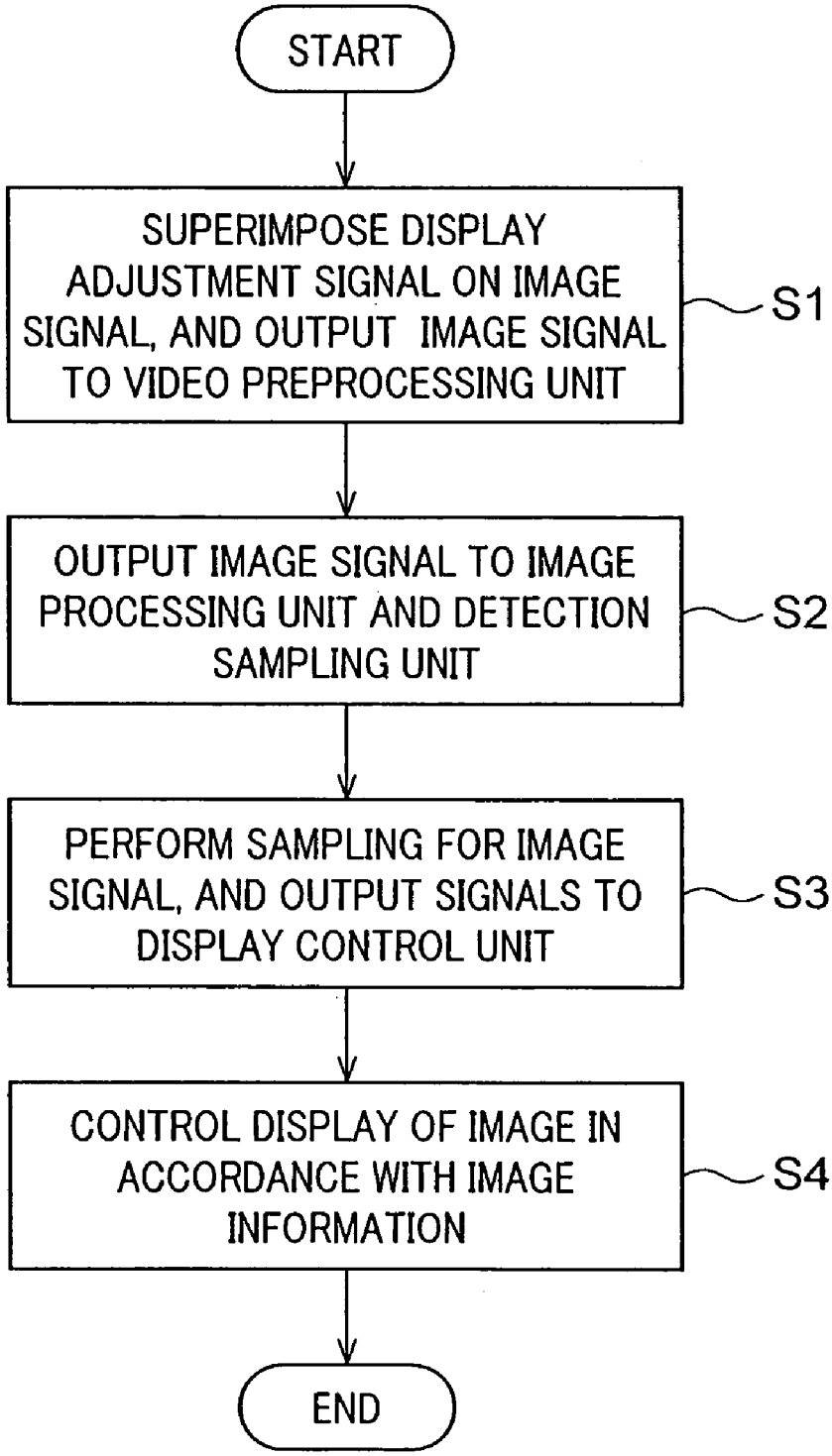
FIG. 4 is a flowchart showing an example of the flow of an operation of controlling the display of image information in the display control device S.
Figure 5:
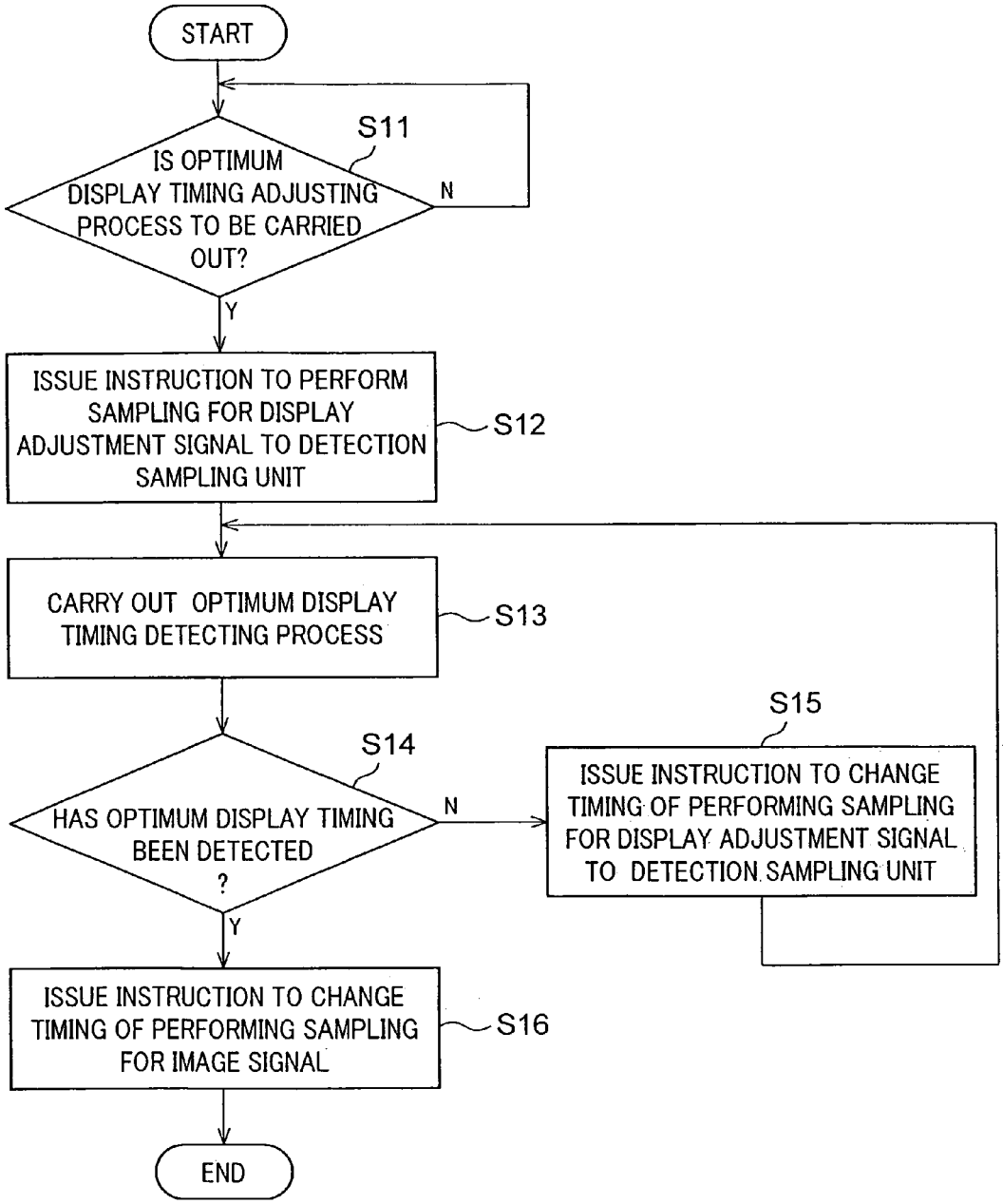
FIG. 5 is a flowchart showing an example of the flow of an operation of adjusting the optimum display timing to be performed by the control unit 7 in the display control device S.

Referring now to FIGS. 4 and 5, the operation to be performed in the display control device S is described. FIG. 4 is a flowchart showing an example of the flow of the operation of controlling the display of image information in the display control device S. FIG. 5 is a flowchart showing an example of the flow of the operation of adjusting the optimum display timing to be performed by the control unit 7 in the display control device S.

In the operation shown in FIG. 4, the drawing unit 1 generates a signal for displaying image (video) information including map information designated by the control unit of a car navigation system, or an image (video) signal representing each color component of RGB, for example. The drawing unit 1 then superimposes the display adjustment signal (a square-wave signal, for example) 62 on a signal portion of the image signal of the R component corresponding to the region outside the display screen of the display unit 5 on the horizontal scanning line and also corresponding to the region that can display the image information. The drawing unit 1 outputs the superimposed image signal, together with a synchronization signal, to the video preprocessing unit 2 (step S1).

Here, the drawing unit 1 recognizes beforehand the area (480×234 dots, for example) of the valid display area 51 of the display unit 5, and accordingly, can superimpose the display adjustment signal 62 on the signal portion of the image signal corresponding to the region that is located outside the valid display area 51 but in the drawing allowed area 52.

The display adjustment signal 62 is a signal that is synchronized with the display pixels (the dots on the display screen). In this embodiment, one drawing dot is formed with one display pixel, and the display adjustment signal 62 is a signal representing one display pixel, accordingly. However, if one drawing dot is formed with two display pixels, the display adjustment signal 62 is a signal representing two display pixels.

The video preprocessing unit 2 receives the image signal and the synchronization signal from the drawing unit 1. After performing the predetermined processing on the image signal in compliance with the I/Fs in the later stages, the video preprocessing unit 2 outputs the image signal and the synchronization signal to the image processing unit 3, and also outputs the image signal to the detection sampling unit 6 (step S2).

The image processing unit 3 then receives the image signal from the video preprocessing unit 2, and performs a luminance and contrast adjusting process for the image signal representing each color component. The display sampling unit 3*a* then performs sampling for the signal of each pixel in the image signal in the predetermined sampling timing, and outputs the pixel signal corresponding to the sampling value to the display control unit 4 (step S3). The image processing unit 3 also receives the synchronization signal from the video preprocessing unit 2. The image processing unit 3 divides the synchronization signal into a horizontal synchronization signal and a vertical synchronization signal, and outputs them to the display control unit 4.

Based on the input pixel signal, the horizontal synchronization signal, and the vertical synchronization signal, the display control unit 4 controls the pixels of each line on the liquid crystal panel of the display unit 5, and controls the display of each pixel in accordance with the image information (step S4). In this manner, the image information (video information) is displayed on the display screen of the display unit 5.

During the operation of controlling the display of the image information, the control unit 7 determines whether the operation of adjusting the optimum display timing is to be performed (step S11), as shown in FIG. 5. When the operation of adjusting the optimum display timing is to be performed (every time a certain period of time has passed, or when an instruction to start the operation is issued by a user operating the operating unit (not shown)) ("Y" in step S11), the control unit 7 issues an instruction to perform sampling for the display adjustment signal 62 superimposed on the image signal to the detection sampling unit 6 (step S12). The detection sampling unit 6 then performs sampling for the display adjustment signal 62 superimposed on the image signal supplied from the video preprocessing unit 2 in the predetermined sampling timing. The detection sampling unit 6 outputs the sampling values to the control unit 7.

Based on the sampling value from the detection sampling unit 6, the determining unit 7*a* of the control unit 7 performs the operation of detecting the optimum display timing (step S13), as described above. For example, the determining unit 7*a* determines whether the sampling value from the detection sampling unit 6 is larger than the threshold value.

The determining unit 7*a* of the control unit 7 next determines whether the optimum display timing has been detected (step S14). Where the optimum display timing has not been detected ("N" in step S14), the control unit 7 issues an instruction to change the sampling timing for the display adjustment signal 62 to the detection sampling unit 6 (step S15) Upon receipt of the instruction, the detection sampling unit 6 changes the sampling timing (or shifts the sampling timing by a predetermined period of time), and performs sampling for the display adjustment signal 62 in the changed sampling timing. The detection sampling unit 6 then outputs the sampling value to the control unit 7.

The optimum display timing detecting process of step S13 is again carried out. This process is repeated until the optimum display timing is obtained. Where the optimum display timing has been detected ("Y" in step S14), the control unit 7 issues an instruction to change the timing of sampling the signal of each pixel in the image signal to the display sampling unit 3*a* of the image processing unit 3 (step S16), when the change cannot be recognized by a user or is difficult for a user to recognize from the image information displayed on the display screen, as described above. In step S16, the control unit 7 may issue an instruction to change the timing of outputting the image signal, to the drawing unit 1 or the video preprocessing unit 2. If the optimum display timing is the same as the sampling timing in the display sampling unit 3*a*, the instruction to change the sampling timing or the instruction to change the timing of outputting the image signal does not need to be issued.

In this manner, the display sampling unit 3*a* of the image processing unit 3 changes the sampling timing to the optimum display timing, and performs sampling for the signal of each pixel in the image signal in the optimum display timing. The pixel signal equivalent to the sampling value is output to the display control unit 4. Alternatively, the timing of outputting the image signal from the drawing unit 1 or the image preprocessing unit 2 is changed, so as to adjust the sampling timing in the display sampling unit 3*a* to the optimum display timing.

As described above, in this embodiment, the detection sampling unit 6 and the display sampling unit 3*a* are independent of each other, so that the sampling of the image signal for displaying the image information and the sampling of the display adjustment signal for adjusting the pixel display timing are performed independently of each other. Based on the sampling value from the detection sampling unit 6, the control unit 7 changes the sampling timing in the detection sampling unit 6 until the optimum timing of displaying pixels is obtained (the adjustment of the dot timing). When the optimum display timing is detected, the display sampling unit 3*a* changes the sampling timing to the optimum display timing. Accordingly, during the adjustment of the dot timing, excellent display of image information without image disturbance can be maintained (continued) so that it appears to the eye of users as if no adjustments were made.

Furthermore, since the change of the sampling timing in the display sampling unit 3*a* to the optimum display timing is made in such a manner that a user cannot notice the change, as described above, even more excellent display of image information without image disturbance can be maintained for users during the adjustment of the dot timing.

Figure 6:
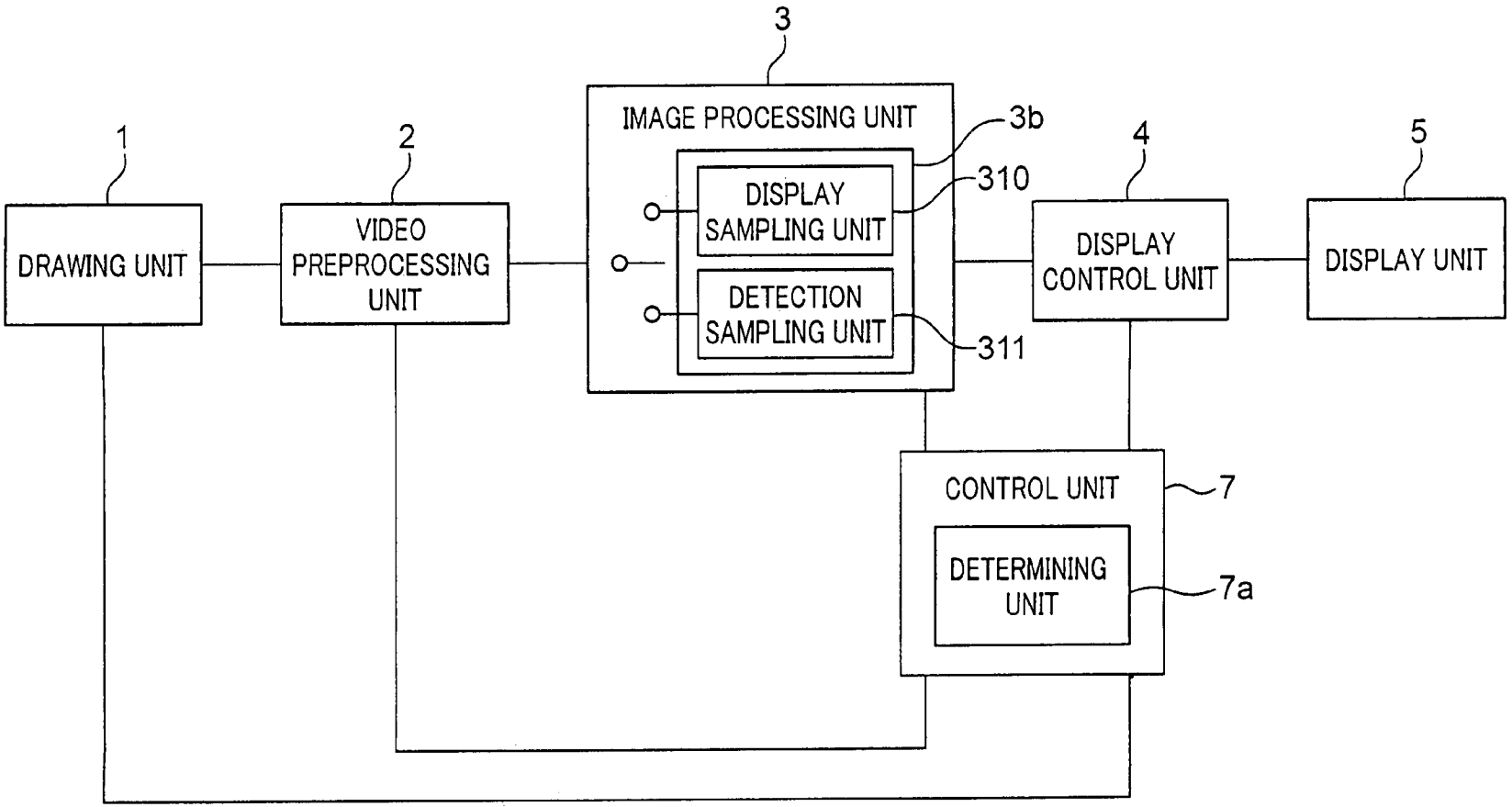
FIG. 6 is a block diagram schematically showing a display control device in which only one sampling unit is provided.

In this embodiment, the display sampling unit 3*a* and the detection sampling unit 6 are designed to be provided separately from each other. However, the present invention is not limited to this structure, and only one sampling unit that can switch functions through a switching means or the like may be employed. FIG. 6 is a block diagram schematically showing a display control device that has only one sampling unit (in the drawing, the same components as those shown in FIG. 1 are denoted by the same reference numerals as those in FIG. 1). In the example shown in FIG. 6, the sampling unit 3*b* functions as a display sampling unit 310 to perform sampling for the display adjustment signal 62 when the display adjustment signal 62 is input. While the pixel signal 61 is input, the sampling unit 3*b* functions as a detection sampling unit 311 to perform sampling for the pixel signal 61.

In this embodiment, the determining unit 7*a* detects the optimum display timing. However, the present invention is not limited to that example, and other various detection methods may be employed. In the above described embodiment, the timing in which the largest value or the smallest value of the sampling values is obtained is detected as the optimum display timing. However, the timing obtained by shifting the timing of the largest value or the smallest value by a phase that is equivalent to a predetermined offset amount may be detected as the optimum timing. The timing shifted by the phase equivalent to the offset amount is set as the optimum timing, because the timing in which the largest value or the smallest value is obtained cannot be set as the optimum timing in the following cases: (i) where a delay is caused in the image signal between the display control unit 4 and the display unit 5; (ii) where a delay is caused in the image signal when the display unit 5 or the like temporarily stores the image signal in a memory or the like; (iii) where the display control unit 4 has jitters in the vicinity of the neighboring pixels in the timing of the largest value or the smallest value. The optimum offset amount is determined for each device, with the cases of (i) through (iii) being taken into consideration. The offset amount is a positive amount in some cases, while being a negative amount in others.

In the above described embodiment, sampling is performed several times for a one-pulse signal that is a display adjustment signal, and the optimum timing is detected based on the sampling values. However, sampling may be performed for signals of several pulses, and the optimum timing may be detected based on the sampling values.

In the above described embodiment, display adjustment signals may be superimposed on two or more signals. For example, display adjustment signals may be superimposed synchronously on all the image signals representing the respective color components of RGB, and sampling is performed several times for each display adjustment signal. The timing of obtaining the largest value of all the sampling values (the largest display adjustment signal representing the G component among the display adjustment signals representing the respective color components of RGB, for example) is detected, and, based on the detected timing, the optimum display timing is detected.

Alternatively, display adjustment signals may be synchronously superimposed on all the image signals representing the respective color components of RGB, and sampling is performed several times for each display adjustment signal. The largest value of the sampling values is then determined for each image signal, and the timing of the mean value of the obtained values is detected. Based on the detected timing, the optimum display timing is detected. In such a structure, matching for the image display timing among the image signals can be performed, even in a case where the largest pixel signals of the image signals are different from one another as the frequency characteristics or the likes are different from one image signal from another.

In the above described embodiment, the display adjustment signals are not limited to square-wave signals, and may be sine-wave signals or triangular-wave signals, for example.

Also, in the above described embodiment, some of the drawing unit 1, the video preprocessing unit 2, the image processing unit 3, the display control unit 4, the detection sampling unit 6, and the control unit 7 may be formed in the same package, and the determining unit 7*a* may be provided in the detection sampling unit 6. The display sampling unit 3*a*, the display control unit 4, and the detection sampling unit 6 may be formed with software to be executed by a CPU (or may function as the image signal sampling unit, the display control unit, and the display adjustment signal sampling unit when a CPU executes a program stored beforehand in a ROM, a hard disk, or the like (the program may be downloaded from a server connected to a network such as the Internet or may be read from a recording medium such as a CD-ROM)).

In the above described embodiment, the display adjustment signal may be superimposed on an image signal of any color component of RGB, and may be superimposed on any signal other than an image signal of a color component of RGB, such as a luminance signal (in the case of YUV), a synchronization signal (such as a vertical synchronization signal or a horizontal synchronization signal), or a composite signal.

In the above described embodiment, the display adjustment signal is superimposed on the signal portion corresponding to the region outside the display screen of the display unit 5 on the horizontal scanning line of an image signal and also on the signal portion corresponding to the region that can display the image information. However, the present invention is not limited to that structure. For example, the display adjustment signal may be superimposed on the signal portion corresponding to the region that is located outside the drawing allowed area 52 but in the signal area 53 and does not contribute to image display on a horizontal scanning line within the vertical return period. Alternatively, the display adjustment signal may be superimposed on a signal portion on a horizontal scanning line on which no image signals exist.

In the above described embodiment, the present invention is applied to a car navigation system. However, the present invention may be applied to any display system that displays TV (television) images, video images, and the like. In such a case, to perform processing on an analog signal such as a TV image, a display adjustment signal is superimposed on the signal portion corresponding to the region outside the display screen of the display unit 5 on a horizontal scanning line of the image signal and also on the signal portion corresponding to the region that can display the image information, as described above.

In the above described embodiment, a liquid crystal panel is employed as an example of the display screen. However, any other panel that has a display screen for pixel display, such as a plasma display panel (PDP), an organic EL panel, or a CRT, may be employed.

It should be noted that the present invention is not limited to the embodiment specifically disclosed above. Rather, the above described embodiment is merely an example, and any variations and modifications having substantially the same structures and achieving the same effects as those claimed in the present invention should be considered to be within the technical scope of the present invention.

This patent application is based on Japanese priority patent application No. 2004-102251, filed on Mar. 31, 2004, the entire contents of which, including the specification, the claims, the drawings, and the abstract, are hereby incorporated by reference.

The invention claimed is:

1. A display control device that causes a display screen to display predetermined image information, comprising:

a display adjustment signal superimposing unit that superimposes a display adjustment signal for adjusting timing of displaying a pixel in accordance with image information, on a portion of a signal corresponding to a region outside the display screen on a horizontal scanning line;

an image signal sampling unit that performs sampling for an image signal in accordance with the image information in predetermined sampling timing;

a display control unit that performs display control for the pixel, using a value obtained through the sampling performed by the image signal sampling unit;

a display adjustment signal sampling unit that performs sampling for the display adjustment signal in predetermined sampling timing;

an optimum display timing detecting unit that detects optimum timing of displaying the pixel by changing the sampling timing in the display adjustment signal sampling unit, based on a value obtained through the sampling performed by the display adjustment signal sampling unit, until the optimum timing of displaying the pixel is determined; and a timing adjusting unit that adjusts the sampling timing in the image signal sampling unit to the optimum display timing, when the optimum display timing detecting unit detects the optimum display timing.

2. The display control device as claimed in claim 1, wherein the timing adjusting unit changes the sampling timing in the image signal sampling unit, so as to adjust the sampling timing in the image signal sampling unit to the optimum, display timing.

3. The display control device as claimed in claim 2, wherein the timing adjusting unit changes the sampling timing in the image signal sampling unit by a predetermined amount at a time.

4. The display control device as claimed in claim 1, further comprising a drawing unit that creates the image information and outputs the image signal, wherein the timing adjusting unit changes timing of outputting the image signal in the drawing unit, so as to adjust the sampling timing in the image signal sampling unit to the optimum display timing.

5. The display control device as claimed in claim 4, wherein the timing adjusting unit changes the timing of outputting the image signal in the drawing unit by a predetermined amount at a time.

6. The display control device as claimed in claim 1, wherein the timing adjusting unit adjusts the sampling timing in the image signal sampling unit to the optimum display timing when a change cannot be recognized by a user or is difficult for a user to recognize from image information displayed on the display screen.

7. The display control device as claimed in claim 6, wherein the timing adjusting unit adjusts the sampling timing in the image signal sampling unit to the optimum display timing when scene switching is performed.

8. The display control device as claimed in claim 6, wherein the timing adjusting unit adjusts the sampling timing in the image signal sampling unit to the optimum display timing when a luminance level of the display screen is lower than a predetermined threshold value.

9. The display control device as claimed in claim 1, wherein the display adjustment signal is superimposed on a portion of a signal corresponding to a region outside the display screen on a horizontal scanning line and also corresponding to a region that can display the image information.

10. The display control device as claimed in claim 1, wherein a signal on which the display adjustment signal is to be superimposed is at least one of an image signal representing a color component contained in the image information, a luminance signal, and a synchronization signal.

11. The display control device as claimed in claim 1, wherein the display adjustment signal is a signal in synchronization with drawing dots.

12. The display control device as claimed in claim 1, wherein the display adjustment signal is a signal representing one display pixel.

13. A display control method for causing a display screen to display predetermined image information, the method comprising the steps of:

superimposing a display adjustment signal for adjusting timing of displaying a pixel in accordance with image information, on a portion of a signal corresponding to a region outside the display screen on a horizontal scanning line;

performing sampling for an image signal in accordance with the image information in predetermined sampling timing;

performing display control for the pixel, using a value obtained through the sampling for the image signal;

performing sampling for the display adjustment signal in predetermined sampling timing;

detecting optimum timing of displaying the pixel by changing the sampling timing for the display adjustment signal, based on a value obtained through the sampling for the display adjustment signal, until the optimum timing of displaying the pixel is determined; and adjusting the sampling timing for the image signal to the optimum display timing, when the optimum display timing is detected.

14. A display control program embodied in a computer-readable medium and representing a sequence of instructions, which when executed by a computer included in a display control device, the instructions cause the computer to display predetermined image information on a display screen, and to function as:

a display adjustment signal superimposing unit that superimposes a display adjustment signal for adjusting timing of displaying a pixel in accordance with image information, on a portion of a signal corresponding to a region outside the display screen on a horizontal scanning line;

an image signal sampling unit that performs sampling for an image signal in accordance with the image information in predetermined sampling timing;

a display control unit that performs display control for the pixel, using a value obtained through the sampling performed by the image signal sampling unit;

a display adjustment signal sampling unit that performs sampling for the display adjustment signal in predetermined sampling timing;

an optimum display timing detecting unit that detects optimum timing of displaying the pixel by changing the sampling timing in the display adjustment signal sampling unit, based on a value obtained through the sampling performed by the display adjustment signal sampling unit, until the optimum timing of displaying the pixel is determined; and a timing adjusting unit that adjusts the sampling timing in the image signal sampling unit to the optimum display timing, when the optimum display timing detecting unit detects the optimum display timing.

* * * * *